US009717999B2

(12) United States Patent
Smokowski et al.

(10) Patent No.: US 9,717,999 B2
(45) Date of Patent: Aug. 1, 2017

(54) INFANT ENTERTAINMENT APPARATUS AND SYSTEM WITH TWO-WAY PROJECTION

(71) Applicant: Mattel, Inc., El Segundo, CA (US)

(72) Inventors: John Thaddeus Smokowski, West Seneca, NY (US); Michael Armbruster, Grand Island, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/939,075

(22) Filed: Nov. 12, 2015

(65) Prior Publication Data

US 2017/0136382 A1 May 18, 2017

(51) Int. Cl.

| | |
|---|---|
| ***A63H 33/00*** | (2006.01) |
| ***A63H 33/22*** | (2006.01) |
| ***A63H 5/00*** | (2006.01) |
| ***A47D 15/00*** | (2006.01) |

(52) U.S. Cl.

CPC ..... *A63H 33/006* (2013.01); *A47D 15/00* (2013.01); *A63H 5/00* (2013.01); *A63H 33/22* (2013.01)

(58) Field of Classification Search

CPC ..... A63H 33/006; A63H 33/22; A47D 15/00
USPC ..... 446/227, 228, 236, 242, 485; 362/253
See application file for complete search history.

(56) References Cited

U.S. PATENT DOCUMENTS 4,285,028 A * 8/1981 Sundin ..... F21S 6/002 362/234
4,939,582 A * 7/1990 Holdredge ..... A47B 23/007 348/836
4,984,380 A * 1/1991 Anderson ..... G09F 19/02 40/455
5,029,047 A * 7/1991 Kachel ..... A63H 33/006 362/253
5,073,825 A * 12/1991 Holdredge ..... A47B 23/007 348/825
5,206,733 A * 4/1993 Holdredge ..... A47B 23/007 348/836
5,555,658 A * 9/1996 Yu ..... F21S 10/007 362/811
6,113,455 A * 9/2000 Whelan ..... A63H 33/006 248/214
6,769,952 B1 * 8/2004 Drosendahl ..... A63H 33/006 446/227
6,908,397 B2 * 6/2005 Armbruster ..... A47D 13/105 446/227
7,172,486 B2 * 2/2007 Drosendahl ..... A63H 33/006 446/175

(Continued)

FOREIGN PATENT DOCUMENTS

EP 456860 A1 11/1991

*Primary Examiner* — Alexander Niconovich

(74) *Attorney, Agent, or Firm* — Edell, Shapiro & Finnan, LLC

(57) ABSTRACT

An infant entertainment apparatus is disclosed. The infant entertainment apparatus includes a housing with an internal cavity and a lens mechanism disposed within the internal cavity. The lens mechanism is configured to project light from the housing in a first direction when the housing is coupled to a mobile arm and the lens mechanism is configured to project light from the housing in a second direction when the housing is decoupled from the mobile arm. Thus, the infant entertainment apparatus may project light downwards into a crib or upwards away from a crib.

20 Claims, 12 Drawing Sheets

(56) References Cited

U.S. PATENT DOCUMENTS 7,470,167 B2 * 12/2008 Clark ..... A63H 33/006 340/573.1
7,476,140 B1 * 1/2009 Hendrickson ..... A63H 33/006 446/175
7,476,142 B2 * 1/2009 Mastrosimone-Gese ..... A63H 33/006 446/227
8,771,033 B2 * 7/2014 Goszewski ..... A63H 33/006 446/227
8,795,023 B2 * 8/2014 Elson ..... A63H 33/006 446/227
8,941,078 B2 * 1/2015 Tantillo ..... A63H 33/006 250/453.11
9,114,326 B2 * 8/2015 Johnson ..... A63H 3/003
9,295,920 B2 * 3/2016 Aboukrat ..... A63H 33/006
2003/0064818 A1 * 4/2003 Drosendahl ..... A63H 33/006 472/118
2005/0026536 A1 * 2/2005 Armbruster ..... A47D 13/107 446/227
2005/0148278 A1 * 7/2005 Drobinski ..... A63H 33/006 446/227
2006/0260663 A1 * 11/2006 Sejnowski ..... A63H 33/22 135/16
2008/0020672 A1 * 1/2008 Osborn ..... A63H 33/006 446/227
2010/0240277 A1 * 9/2010 Rapp ..... A63H 33/006 446/485
2012/0188451 A1 * 7/2012 Schmidt ..... H04N 9/3141 348/553
2014/0065925 A1 * 3/2014 Oren ..... A63H 33/22 446/227
2016/0067622 A1 * 3/2016 Aderka ..... A63H 33/006 446/227

* cited by examiner

INFANT ENTERTAINMENT APPARATUS AND SYSTEM WITH TWO-WAY PROJECTION

FIELD OF THE INVENTION

The present invention is directed toward an infant entertainment apparatus and, in particular, a soother that can be selectively project light in different directions.

BACKGROUND

In order to entertain or soothe young children, and especially infants, parents frequently place and/or install entertainment devices, such as soothers, mobiles, vibrating plush toys, etc. onto, into, or around a child's crib or bed. Many of these devices produce lights and/or sounds designed to soothe and/or entertain a child as the child falls asleep. In some instances it may be preferable to provide an entertainment device, such as a mobile, above the child so that the child can see the entertainment device while lying in a supine position. However, in other instances it may be beneficial to provide an entertainment device in the crib with the child, perhaps if the child is sleeping in a prone position or near a crib. For example, when soothing a very young infant with still developing vision, it may be desirable to provide visual stimuli on a mobile. However, as the child grows older, a mobile may become a hazard or nuisance and it may be desirable to provide soothing lights and sounds from a device that is elsewhere in the child's room. Accordingly, infant entertainment devices that provide soothing features when in or around the crib and when above the crib are desired.

SUMMARY

The present invention generally relates to an infant entertainment apparatus. According to one example embodiment, an infant entertainment apparatus includes a housing with an internal cavity and a lens mechanism is disposed within the internal cavity. The lens mechanism is configured to project light from the housing in a first direction when the housing is coupled to a mobile arm and configured to project light from the housing in a second direction when the housing is decoupled from the mobile arm. Thus, the infant entertainment apparatus may project light downwards into a crib or upwards away from a crib, such as onto the walls and ceiling of a bedroom.

BRIEF DESCRIPTION OF THE DRAWINGS

Like reference numerals have been used to identify like elements throughout this disclosure.

DETAILED DESCRIPTION

Presented herein are an infant entertainment apparatus and system with two-way light projection. Generally, the infant entertainment apparatus is configured to project light downwards (i.e., into a crib) when mounted on a mobile arm (i.e., onto a mobile or canopy) and configured to project light upwards (i.e., onto a ceiling) when removed from the mobile arm. In some instances, mounting the infant entertainment apparatus on a mobile arm may also activate a mobile mechanism that can drive a mobile in a spinning motion. However, once the infant entertainment apparatus is removed from the mobile arm, the mobile mechanism may be turned off or deactivated such that the infant entertainment apparatus does not include any moving parts when removed from the mobile arm. The infant entertainment apparatus may also produce sounds to accompany the light and movement. In view of these features, the infant entertainment apparatus disclosed herein may soothe and/or entertain a child from a number of locations in a bedroom (i.e., crib-attached, in the crib, or near the crib) as the child falls asleep.

Figure 1:
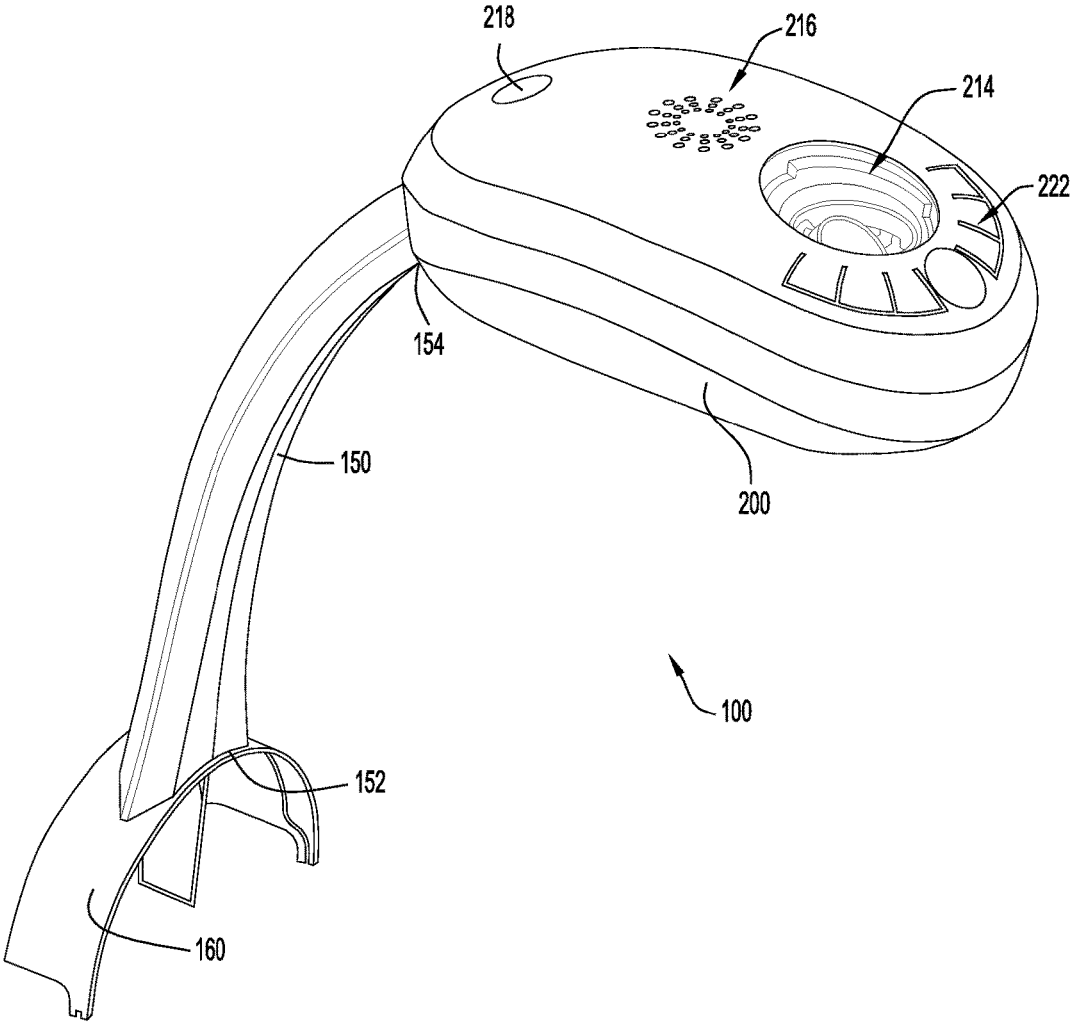
FIG. 1 shows a top perspective view of an infant entertainment system including a soother with two-way projection that is mounted on a mobile arm, according to an example embodiment.

Now referring to FIG. 1, an infant entertainment system 100 according to at least one example embodiment is shown from a top perspective view. The infant entertainment system 100 includes a mobile arm 150 and an infant entertainment device 200. The infant entertainment device 200, which may be alternatively referred to as soother 200, is removably mountable on the mobile arm 150 which, in turn, is removably mountable on a child's bed or crib. For example, the mobile arm 150 may include a base 160 configured to clip, snap, or otherwise secure or attach the mobile arm 150 to a crib rail, so that the infant entertainment system 100 is crib-attachable. As is described in further detail with regards to FIGS. 2 and 3, when the soother 200 is mounted on the mobile arm 150 and the mobile arm 150 is attached to a crib, the mobile arm 150 is positions the soother 200 above the crib in the same manner that many conventional mobiles are positioned over a crib.

Still referring to FIG. 1, the infant entertainment system 100 may include a number of features and modes. For example, the system 100 may include a speaker 216 so that any light projections or mobile movements can be accompanied by music and sounds. Additionally, the soother 200 may include controls 222 to allow a parent to control, among other aspects, the music, the volume of the music, the image or pattern of light projection, and/or mobile speed. In some embodiments, the system 100 may also include an IR receiver 218 so that a parent can control the system 100 remotely.

Figure 2:
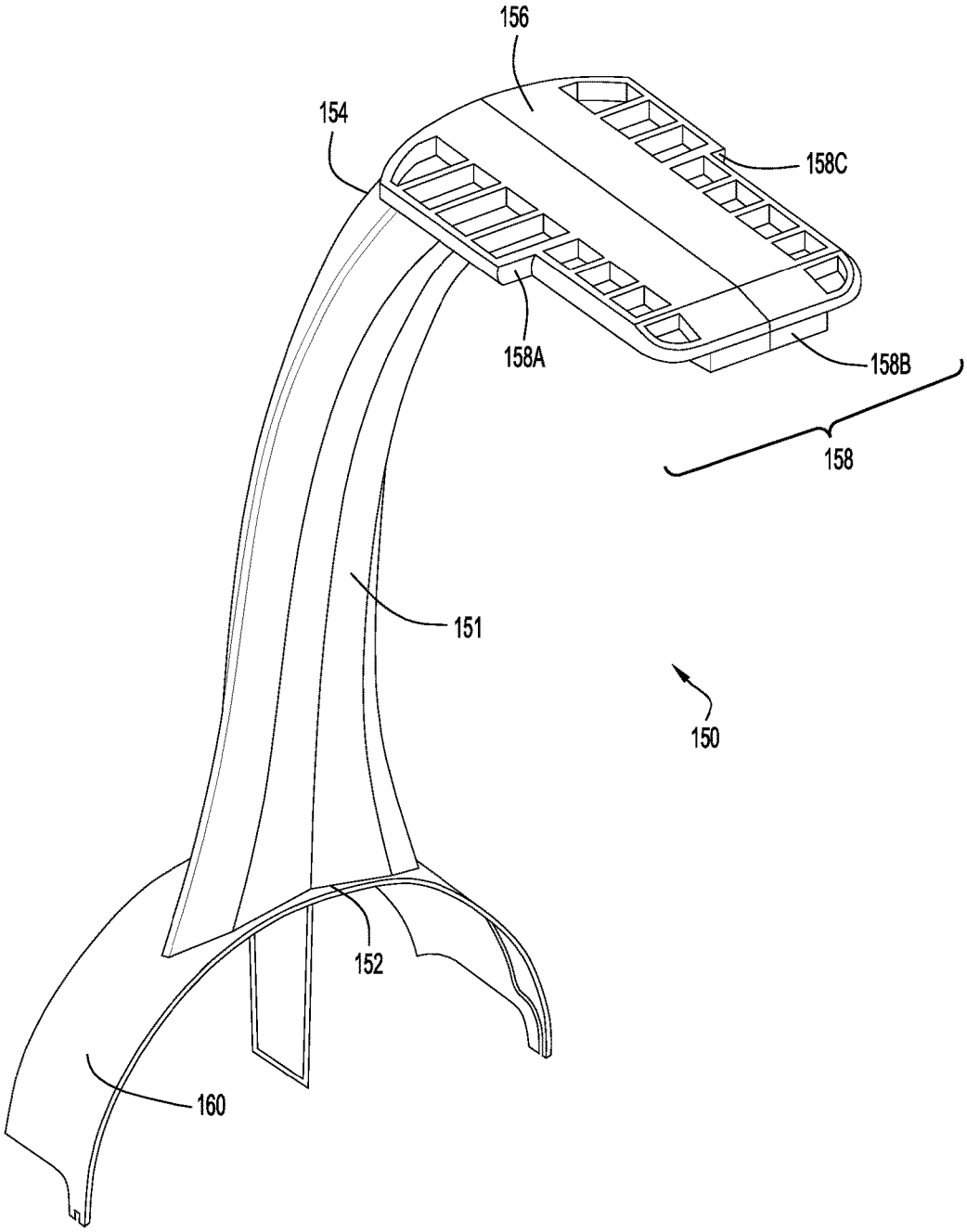
FIG. 2 shows a top perspective view of the mobile arm of the infant entertainment system of FIG. 1, according to an example embodiment.

Now referring to FIG. 2, the mobile arm 150 includes an elongate member 151 that extends between a proximate end 152 and a distal end 154. The elongate member 151 is coupled, either fixedly or removably, to the base 160 at the proximate end 152 and extends upwards and slightly laterally away from the base 160, such that the distal end 154 of the elongate member 151 is disposed above a crib or bed that when the mobile arm 150 is mounted thereto (perhaps via base 160). The mobile arm 150 also includes a mounting portion 156 that extends laterally (i.e., in the X-direction) from the distal end 154 of the elongate member 151 and is configured to be secured to the soother 200 so that the soother 200 is positionable over a child who is disposed in the crib or bed. For example, in some embodiments, the soother 200 is removably mountable on the mounting portion 156 of the mobile arm 150 by sliding the mounting portion into an opening or receptacle included in the soother 200.

Still referring to FIG. 2, the mounting portion 156 also includes one or more engagement portions 158 configured to engage and/or activate different portions, features, or mechanisms of the soother 200. For example, in the embodiment depicted in FIG. 2, the mounting portion 156 includes engagement portions 158A and 158C disposed on opposite lateral side of the mounting portion 156 and an engagement portion 158B disposed at the end of the mounting portion 156 opposite the elongate member 151. However, in other embodiments, the mounting portion 156 may include any number of engagement portions 158 disposed on any portion of the mounting portion 156. For example, in some embodiments, the mounting portion 156 may include engagement portions 158 on the bottom or underside of the mounting portion 156.

In different embodiments, each of the engagement portions 158 may engage, actuate, or otherwise interact with different parts, portions, or mechanisms of the soother 200. For example, at least one of the engagement portions 158 may removably secure (i.e., lock) the soother 200 to the mobile arm 150 when the soother 200 is installed thereon and at least one other engagement portion 158 may be configured to actuate a mechanism, such as a mobile mechanism, included in the soother 200. In the depicted embodiment, engagement portion 158A engages a trigger mechanism that causes a lens mechanism included in the soother 200 to move or rotate, as is described in detail below with regards to FIGS. 5-7.

Figure 3:
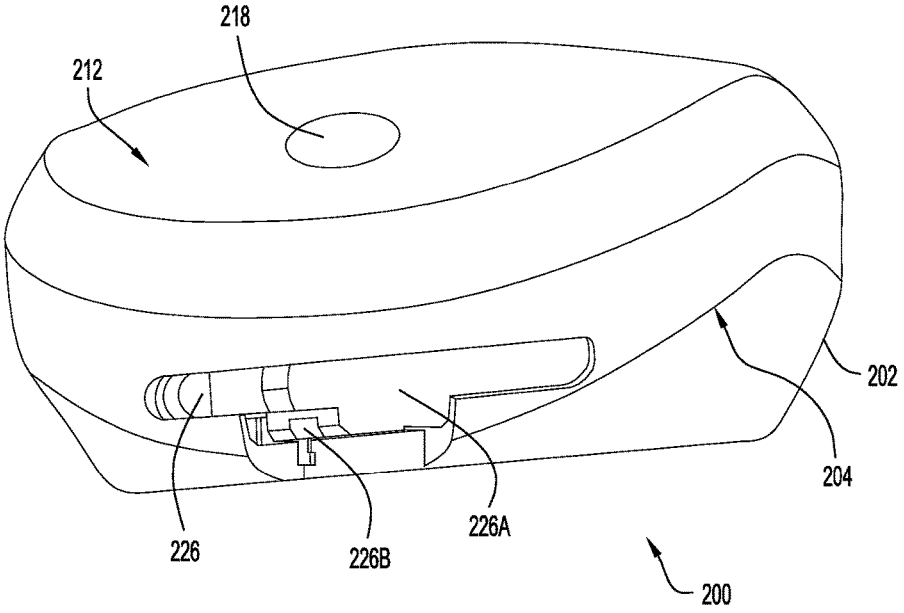
FIG. 3 shows a rear perspective view of the soother of the infant entertainment system of FIG. 1 removed from the mobile arm, according to an example embodiment.

Now referring to FIG. 3, but with continued reference to FIGS. 1 and 2, the soother 200 includes a bottom portion 204 and a top portion 212 that collectively form an ellipsoid shaped housing 202. The housing 202 defines and surround an inner cavity 240 that houses various components, mechanisms, and assemblies of the soother 200. At one end of the ellipsoid (i.e., a side of the housing 202), the housing includes a receptacle 226 configured to mate with the mounting portion 156. The receptacle includes a first receptacle portion 226A and a second receptacle portion 226B. The first receptacle portion 226A is configured to receive the majority of the mounting portion 156 and the second receptacle portion 226B is configured to receive engagement portion 158B. Thus, in order to mount the soother 200 on the mobile arm, the receptacle 226 may be aligned with the mounting portion 156 and the soother 200 can be slid onto the mobile arm 150.

In some embodiments, the engagement portion 158B may selectively lock or secure the soother 200 to the mounting portion 156; however, in other embodiments, the engagement portion 158B may simply add stability to the engagement between the mounting portion 156 of the mobile arm 150 and the receptacle 226 of the soother 200. In embodiments where the soother 200 is locked or secured onto the mounting portion 156 of the mobile arm 150, the soother 200 may include a release button. Additionally or alternatively, the soother 200 may be secured to the mobile arm 150 with a detent or other such mechanism such that a certain amount of force is required to release the soother 200 from the mobile arm 150. However, regardless of how or if the soother 200 is locked onto the mobile arm 156, the soother 200 is releasably coupled to the mobile arm 150.

Figure 4:
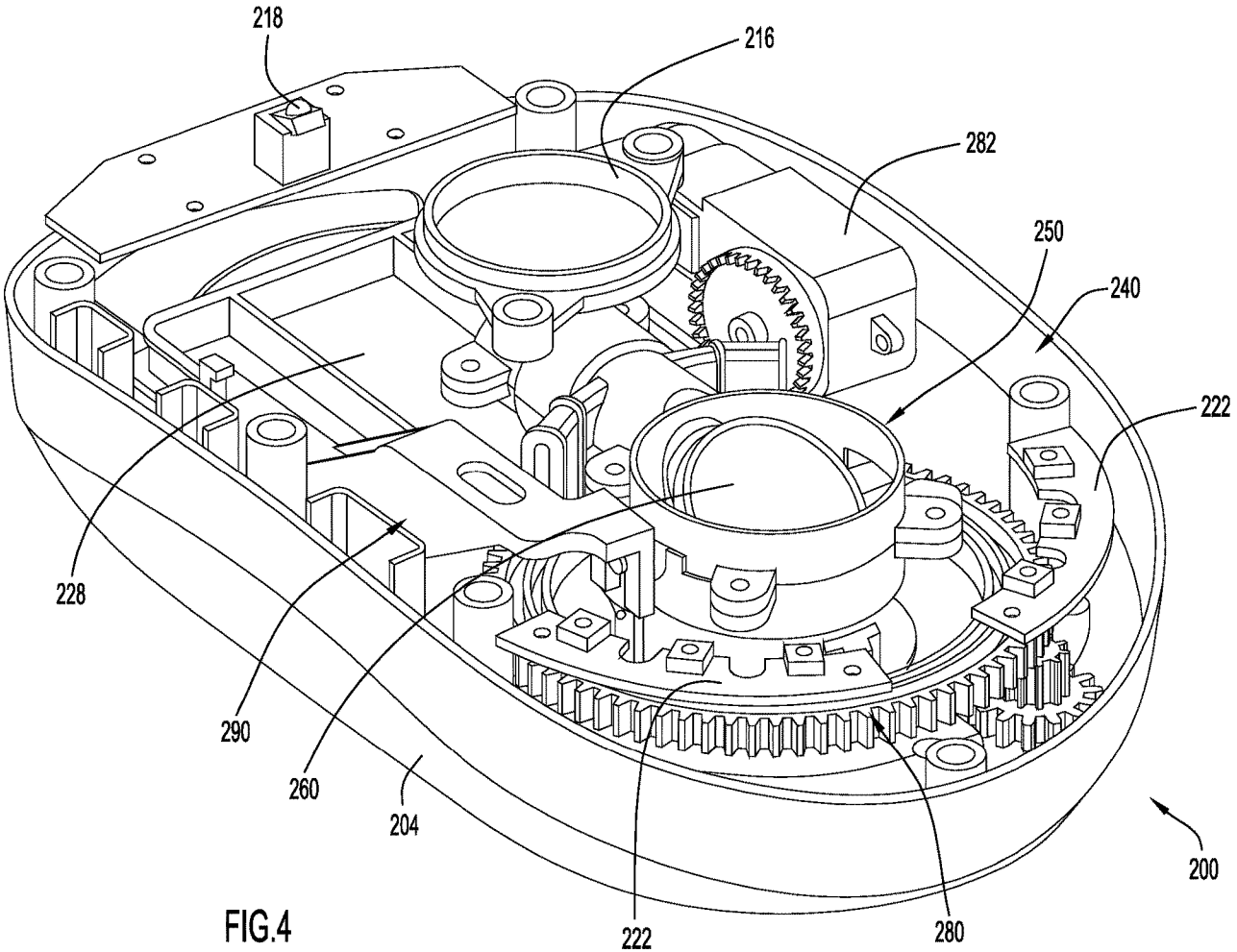
FIG. 4 shows a top perspective of the soother of the infant entertainment system of FIG. 1 with a top portion of the housing removed, according to an example embodiment

In FIG. 4, the soother 200 is shown from a top perspective view with the top portion 212 removed. Consequently, the various mechanisms/assemblies, including lens mechanism 250, mobile mechanism 280, and trigger mechanism 290, included in cavity 240 are shown. The lens mechanism 250 is disposed in a central portion of the inner cavity 240 and includes a movable optical component 260, such as a mirror, that is aligned with a first housing lens 206 (see FIG. 1) included in the bottom portion 204 of the housing 202 and a second housing lens 214 included in the top portion 212 of the housing. Consequently, the lens mechanism 250 can project light from the soother 200 through either the first housing lens 206 or the second housing lens 214 if aligned in a certain manner. As is described in further detail with regards to FIGS. 5 and 6, the trigger mechanism 290 is configured to provide a connection between the lens mechanism 250 and the mobile arm 150 so that the lens mechanism 250 may be actuated (i.e., rotate) in response to the soother 200 being mounted on the mobile arm 150. The mobile mechanism 280 is disposed adjacent to and around the lens mechanism 250 and configured to interact with both the mobile arm 150 (i.e., when the mounting portion 156 enters the inner cavity 240 via the receptacle 226) and a mobile ring 286 positioned adjacent and around the lower housing lens 206.

Still referring to FIG. 4, in some embodiments, the soother 200 may also include internal components to facilitate the additional features or components shown or represented externally in FIG. 1. For example, the soother 200 may include a speaker 216 configured to produce audio output, such as songs or music, to accompany any light projection or toy movements produced by the soother 200. As another example, the soother 200 may include a battery compartment 228 to enable portable use of any electrical components. Still further, the soother 200 may include controls 222 in the form of a printed circuit board (PCB) to enable parents to easily change between different modes (i.e., sleeping, soothing, entertaining), set the soother 200 to work on a timer, control the volume of music, the speed of mobile movement, etc. and an IR receiver 218 to enable any control inputs to be input via a remote, a mobile device, etc.

Figure 5:
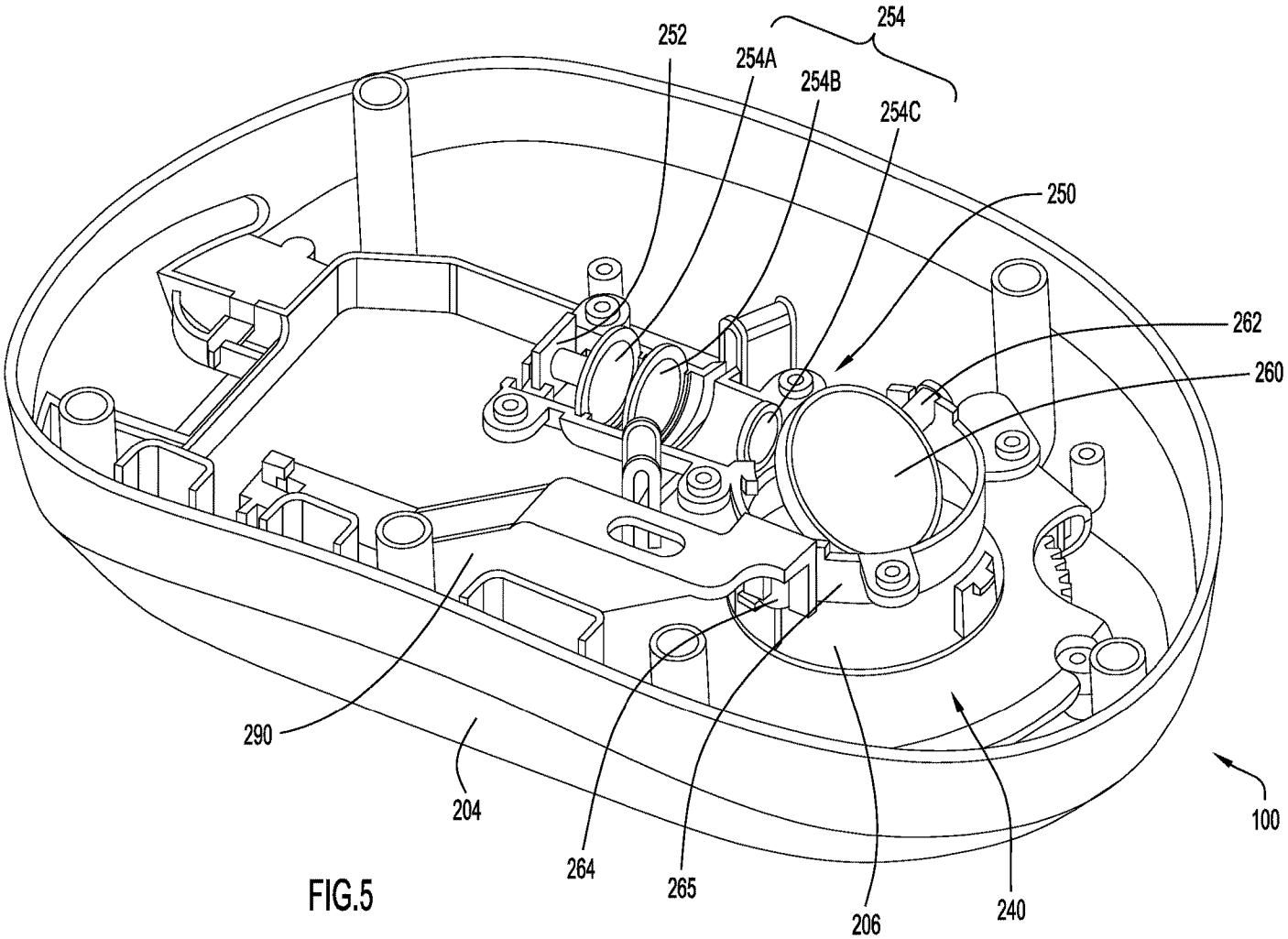
FIG. 5 shows a top perspective view of a lens mechanism and a trigger mechanism included in the soother of FIG. 1, according to an example embodiment.

Now referring to FIG. 5, the lens mechanism 250 includes a light source 252 that is optically aligned with a series of optical components 254, such as lenses, and a movable optical component 260. Thus, when the light source 252 emits light, the emitted light may be transmitted towards the movable optical component 260 through the series of lenses 252. In some embodiments, the lenses may include or be screens or films with images, stencils, etc. that may cause an image to be projected onto the movable optical component 260 and in other embodiments the lenses may be or include an image on a display, such as a negative-mode liquid crystal display (LCD). Additionally or alternatively, in some embodiments, at least one of the lenses included in the series of lenses may rotate about an axis parallel to the light path, such that a rotating image is projected onto the movable optical component 260. Still further, some of the lenses may focus the light on the mirror and/or serve as a diffusion layer to smooth over any image patterns or projections being focused on the movable optical component 260.

For example, in the embodiment depicted in FIG. 5, lens 254A may include an image and may rotate about its central axis, lens 254B may be a diffusion layer, and lens 254C may focus the projected and smoothed rotating image on the movable optical component 260. The movable optical component 260 may then reflect, deflect or otherwise direct the rotating image upwards or downwards depending on the configuration of the movable optical component 260. In the depicted embodiment, the movable optical component 260 is a mirror and, thus, when positioned as shown in FIG. 5, the movable optical component 260 reflects light received from light source 252 downwards, through housing lens 206. However, the movable optical mirror 260 is configured to move between at least two positions in order to project received light (and images) upwards or downwards. In order to facilitate this movement, the movable optical component 260 includes lateral supports 262 that extend beyond opposite lateral edges of the optical component 260 and rest in an annular support ring 265. However, in other embodiments, the movable optical component 260 may include any features or mechanisms that allow the movable optical component 260 to move between positions that project received light (and images) upwards and downwards through housing lenses 214 and 206, respectively.

Figure 6:
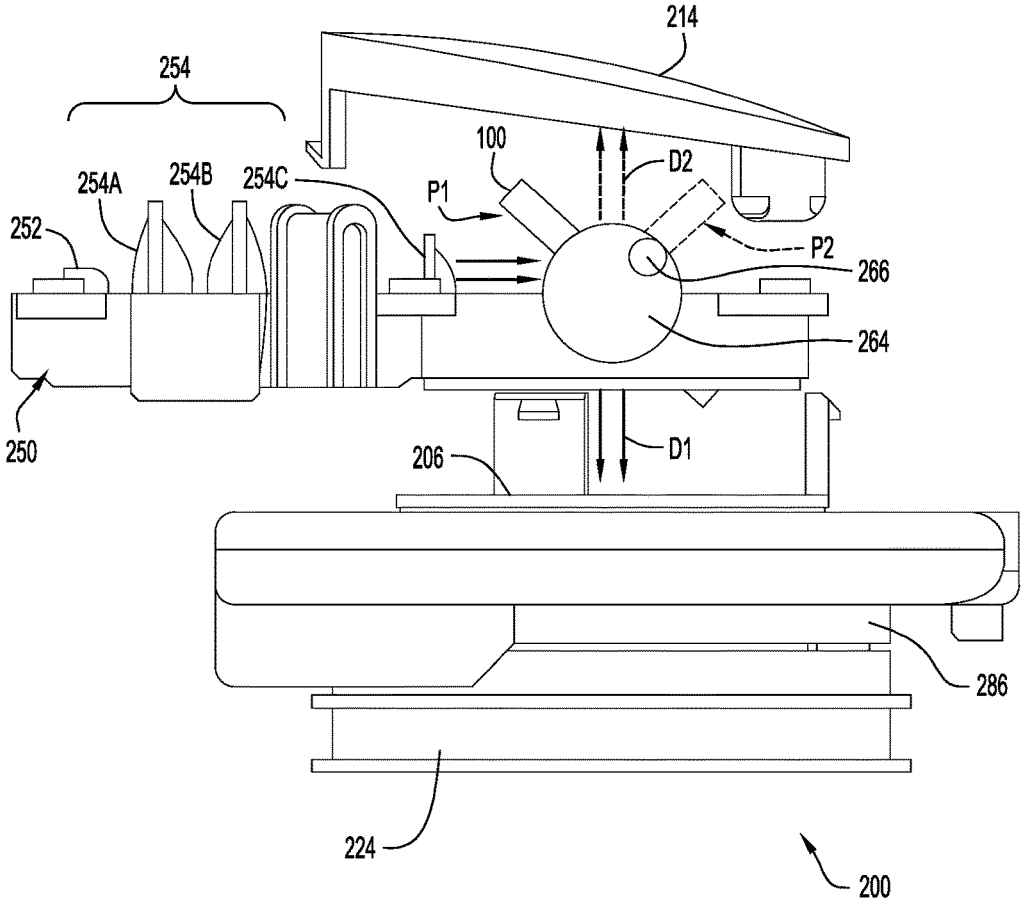
FIG. 6 shows a side perspective view of the lens mechanism of FIG. 5 in a first position and a second position.

As shown in FIG. 6, in the depicted embodiment, the supports 262 allow the movable optical component 260 to move between a first position P1 and a second position P2. When the movable optical component 260 is in position P1, the movable optical component 260 is titled at a first angle with respect to a vertical axis so that it deflects light in the first direction D1 towards the first housing lens 206. By comparison, when the movable optical component 260 is in position P2, it is tilted the opposite direction about the vertical axis (albeit to substantially the same angle), so that it deflects light in the second direction D2 towards the second housing lens 214. In some embodiments, the movable optical component 260 is tilted to positions P1 and P2 that are approximately 45 degrees offset from the vertical axis, such that the first position P1 and the second position P2 are separated or offset by approximately 90 degrees. In order to move the movable optical component 260 between position P1 and P2 the trigger mechanism 290 may engage a positioning member 264 included on one of the supports 262.

Figure 7:
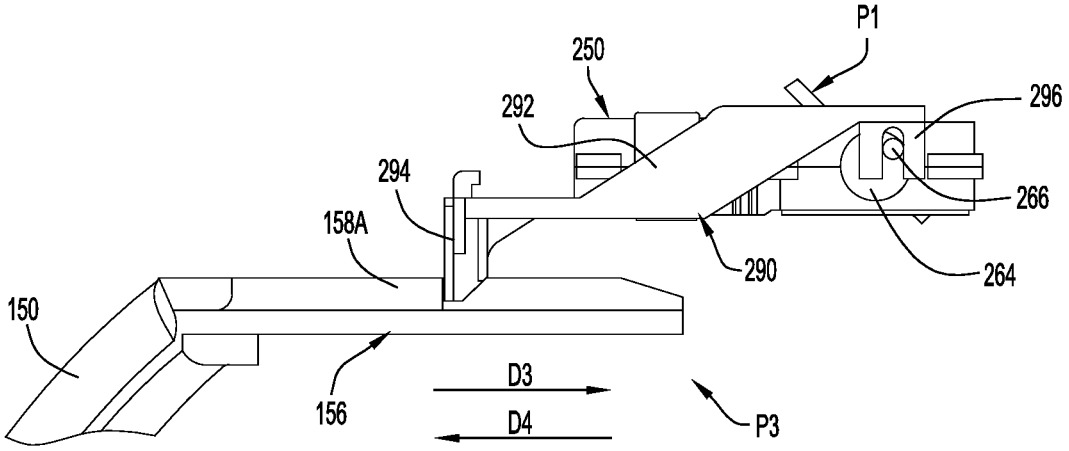
FIG. 7 shows a side perspective view of the trigger mechanism of FIG. 5 while actuated by the mobile arm of FIG. 2, according to an example embodiment.
Figure 8:
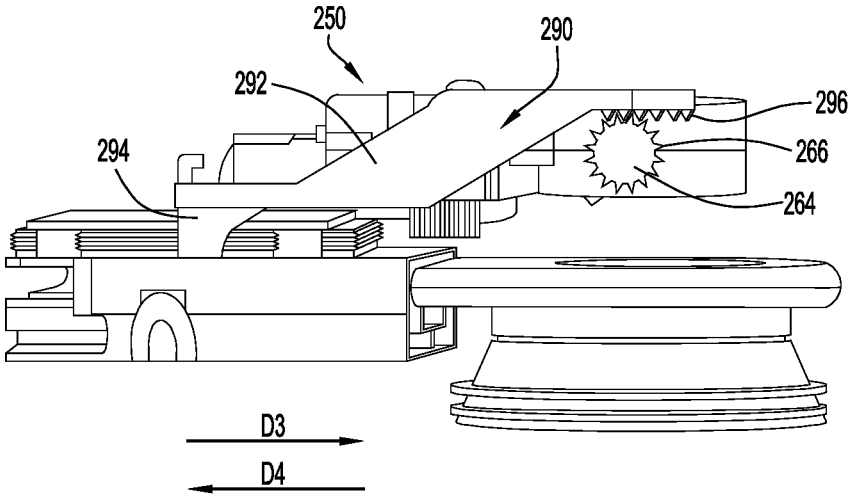
FIG. 8 shows a side perspective view of a trigger mechanism according to another example embodiment.

More specifically, and as shown in FIGS. 7 and 8, the trigger mechanism 290 includes a cam member 292 with a first portion 294 configured to engage the mounting portion 156 of the mobile arm 150 and a second portion configured to engage a cam follower 266 included on the positioning member 264 of the movable optical component 260. Thus, as the soother 200 is mounted onto the mobile arm 150, an engagement portion 158 (engagement member 158A in the depicted embodiment) contacts the first portion 294 of the trigger mechanism 290 and begins to move the cam member 292 in direction D3. As the cam member 292 moves in direction D3, the second portion 296 of the cam member 292 engages and moves the cam follower 266 of the movable optical component 260, causing the support 262 to move (i.e., rotate) the movable optical component 260 towards its second position P2. When the soother 200 is fully mounted on the mobile arm 150, the cam member 292 will be moved to its actuated position P3 and the movable optical component will be in its second position P2.

In some embodiments, the cam member 292 is biased to a non-actuated position P4 and, thus, as the soother 200 is removed from the mobile arm 150, the cam member 292 moves in direction D4 (i.e., back towards its original, rest position) and moves the movable optical component 260 back to its first position P1. Thus, in some embodiments, the movable optical component 260 will be in position P1 (i.e., projecting light downwards) when attached to the mobile arm 150 and will be the second position P2 (i.e., projecting light upwards) when removed from the mobile arm 150 and/or is otherwise not engaged. Consequently, the soother 200 may project light downwards into a crib, onto a mobile, onto a canopy, etc. when attached to the mobile arm 150 and may project light upwards onto a ceiling or around a room when removed from mobile arm 150 (i.e., placed atop a dresser).

Still referring to FIGS. 7 and 8, in different embodiments, the cam member 292 may engage the movable optical component 260 in different manners and still move the movable optical component between position P1 and position P2. For example, in the embodiment shown in FIG. 7, the second portion 296 of the cam member 292 is a slot and the cam follower 266 of the movable optical component 260 is a rod or protrusion that is configured to ride in the slot. Thus, as the cam member 292 moves laterally, the cam follower 266 can translate the lateral movement of the cam member 292 into rotational movement by moving laterally and vertically in the slot, thereby rotating the movable optical component. By comparison, in FIG. 8, the second portion 296 of cam member 292 includes teeth and the cam follower 266 of the movable optical component 260 includes teeth surrounding the positioning member 264. Thus, as the cam member 292 moves laterally (i.e., when pushed in direction D3 by an engaging member of the mobile arm 150), the second portion 296 will drive the positioning member 264 to rotate and move the movable optical component 260 between its first position P1 and second position P2.

Figure 9:
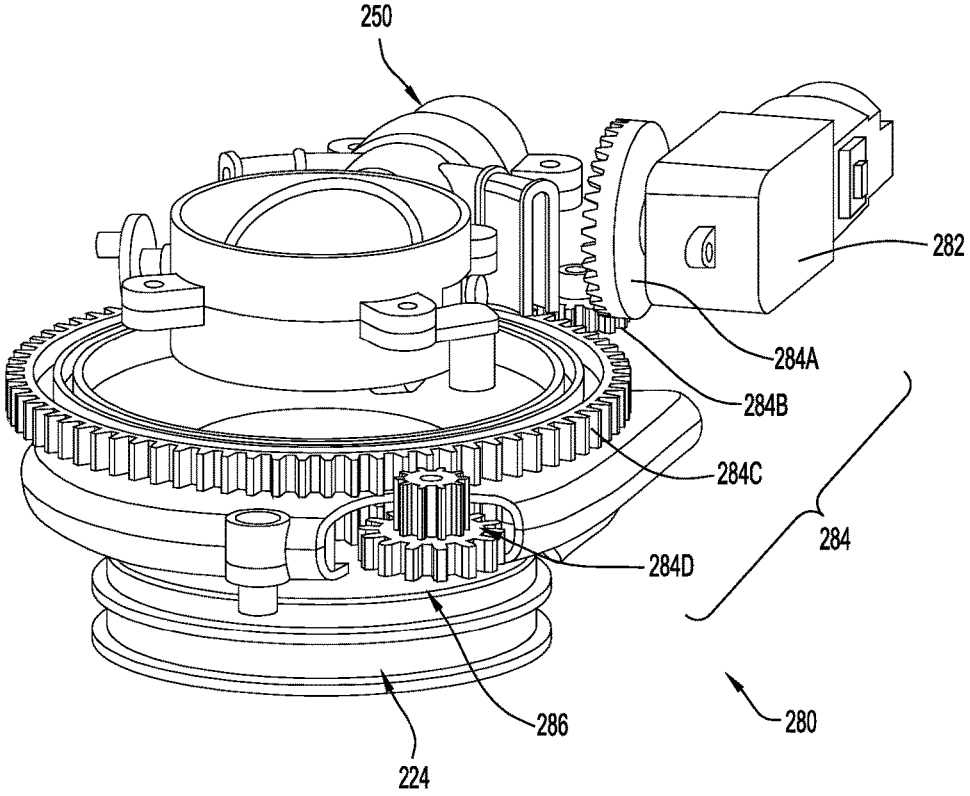
FIGS. 9 and 10 show front and top perspective views, respectively, of a mobile mechanism included in the soother of FIG. 1.
Figure 10:
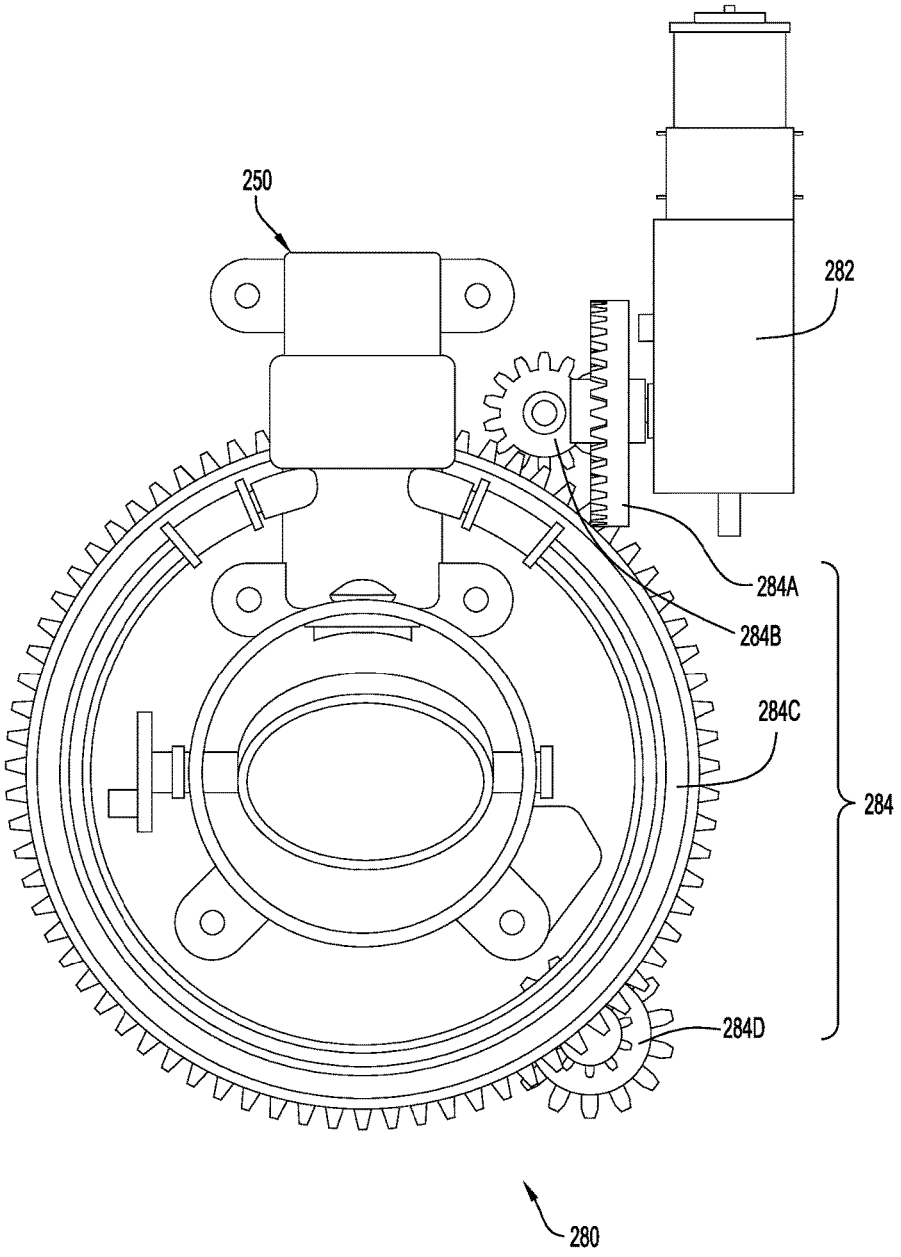

Now referring to FIGS. 9 and 10, the mobile mechanism 280 is shown from a side and top view, respectively. The mobile mechanism 280 includes a motor 282 and a gear assembly 284 that substantially surround the lens mechanism 250; however, in at least some embodiments, the mobile mechanism 280 operates independently of the lens mechanism 250. In other words, in at least some embodiments, the mobile mechanism 280 is not triggered by trigger assembly 290. That being said, the mobile mechanism 280 may be triggered or actuated at similar times to the lens mechanism. For example, in some embodiments, the lens mechanism is actuated (via trigger mechanism 190) by a first engaging portion 158 of the mobile arm 150 and the mobile mechanism 180 is actuated by a second engaging portion 158 of the mobile arm 150 and, thus, both the lens mechanism 250 and the mobile mechanism 280 are actuated when the soother 200 is mounted on the mobile arm 150.

For example, in some embodiments, engaging portion 158C may actuate a switch included in the soother 200 that is electrically coupled to the motor 282 and, thus, when the soother 200 is mounted on the mobile arm 150, the motor 282 is turned on and the mobile mechanism 280 is activated.

However, similar to the lens mechanism 250, the mobile mechanism 280 is biased to a rest or off position, such that if the soother 200 is not mounted on the mobile arm 150, the mobile mechanism 180 will not turn on. Thus, if the soother 200 is removed from the mobile arm 150 and placed in or around a crib, the soother 200 will not be able to provide any external movement that might injure a child or cause the soother 200 to fall of an elevated surface, such as the top of a dresser.

In the specific embodiment depicted in FIGS. 9 and 10, the motor 282 is coupled to a gear assembly 284 that extends around the lens assembly 250 without impeding or extending into the optical paths between the lens assembly 250 and the housing lenses 206, 214. Thus, projections created by lens assembly 250 can project outwards from soother 200 unimpeded and unaltered. More specifically, in the embodiment shown in FIGS. 9 and 10, the gear assembly 284 includes a double gear 284C that wraps around the lens assembly 250, or at least around the movable optical component 260 and is driven by a small cylindrical gear 284B that is coupled to the motor via crown gear 284A. The double gear 284C drives a second double gear 284D that is coupled to a mobile ring 286. Thus, when the motor 282 is turned on, the motor 282 spins the gear assembly around a central axis aligned with the central axis of the movable optical component 260 and causes the mobile ring 286 to spin. In the depicted embodiment, the mobile ring 286 is fixedly coupled to a connector 224 for a mobile/canopy and, thus, when the motor 282 is turned on the mobile/canopy (not shown in FIGS. 9 and 10), as well as any hanging toys attached thereto, will spin in a circular motion.

Figure 11:
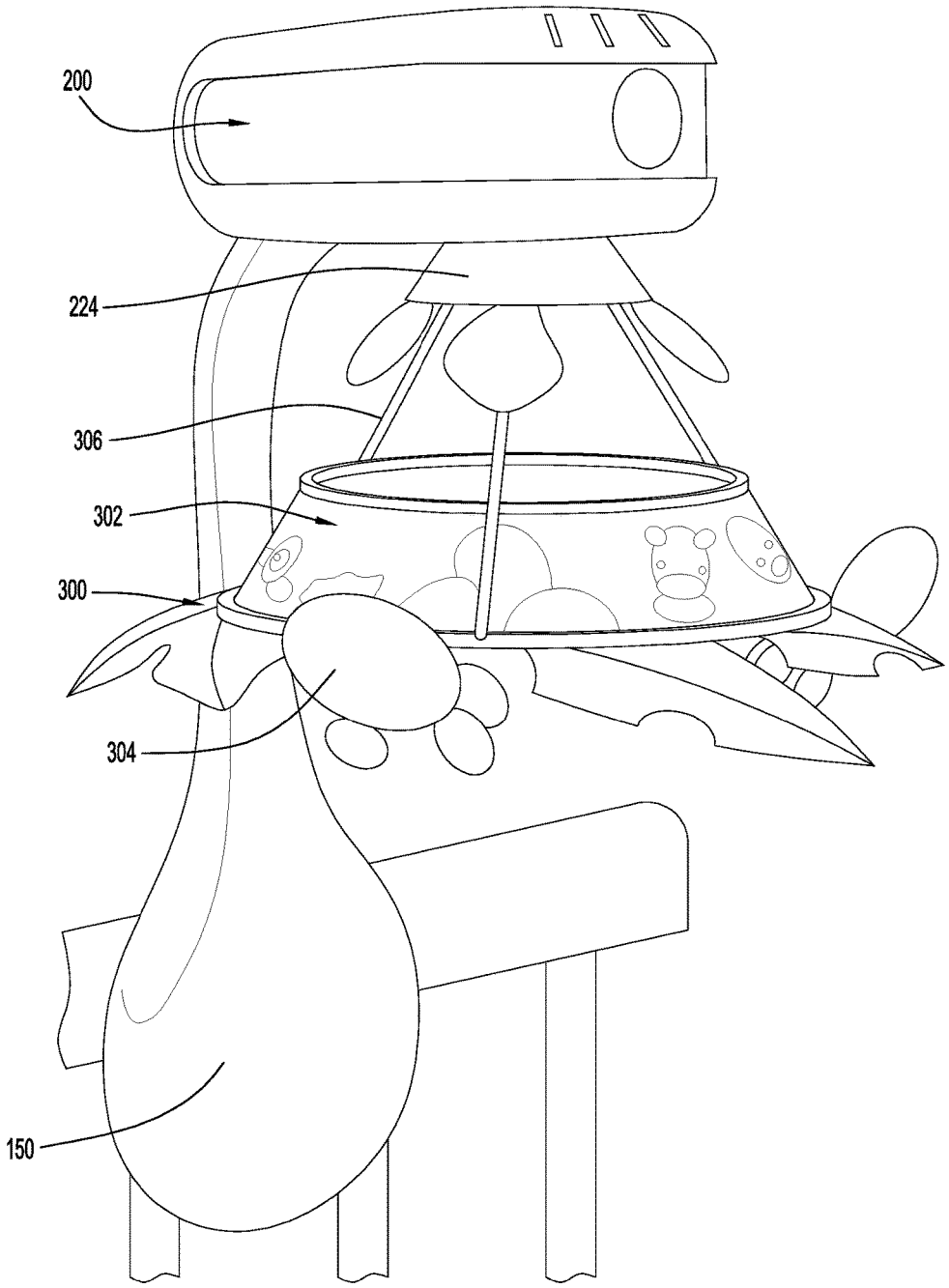
FIG. 11 shows a front perspective view of an infant entertainment system including a soother with two-way projection that is mounted on a mobile arm, according to an example embodiment.
Figure 12:
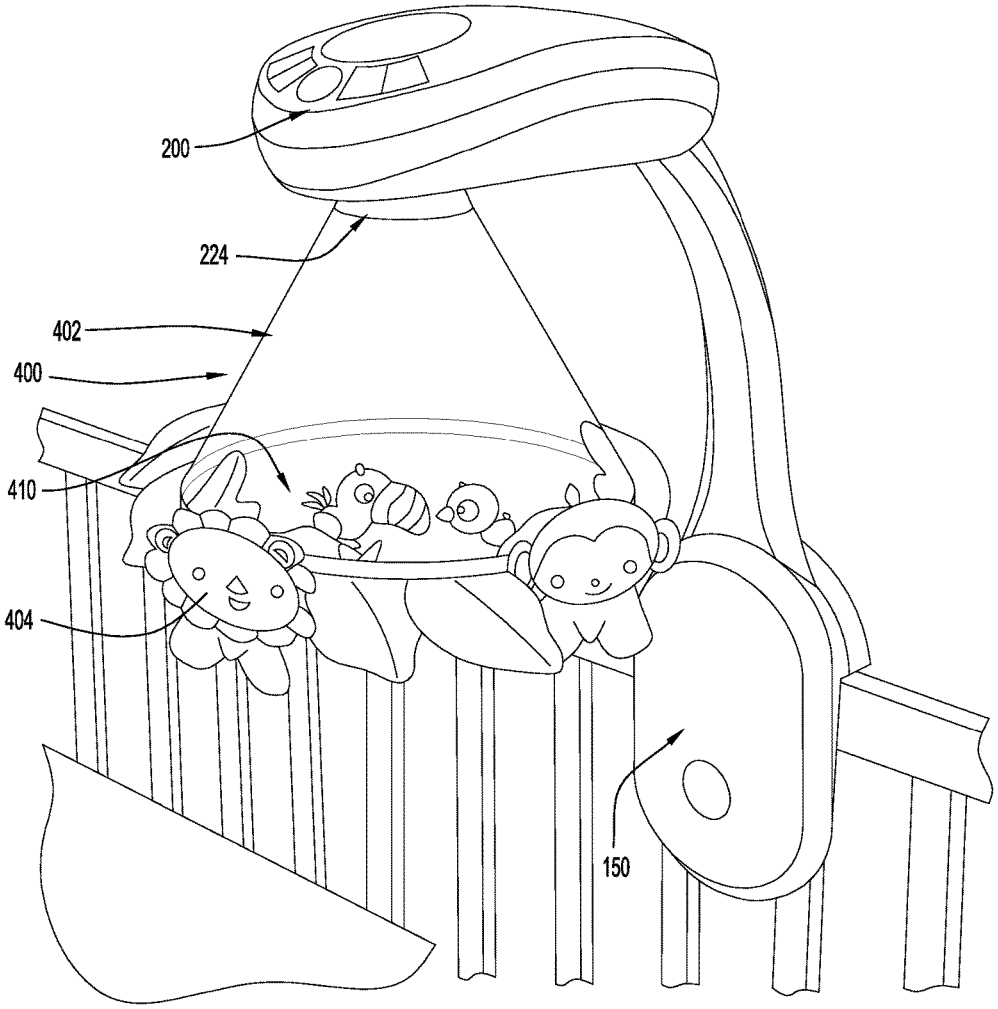
FIGS. 12 and 13 show front and bottom perspective views, respectively, of an infant entertainment system including a soother with two-way projection that is mounted on a mobile arm, according to an example embodiment.
Figure 13:
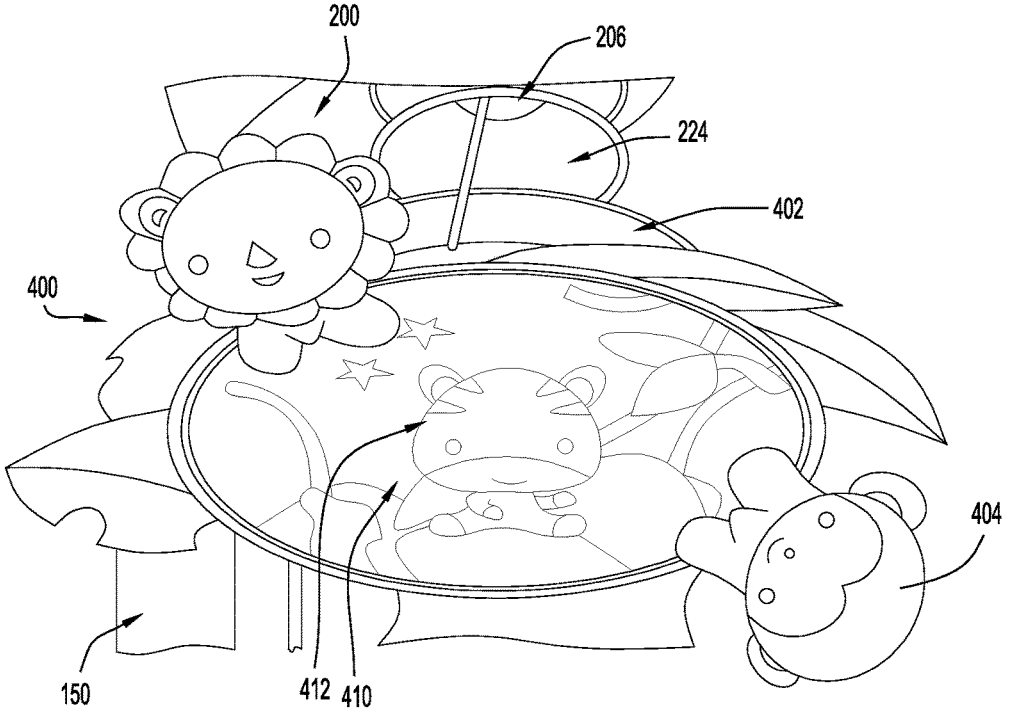
Figure 14:
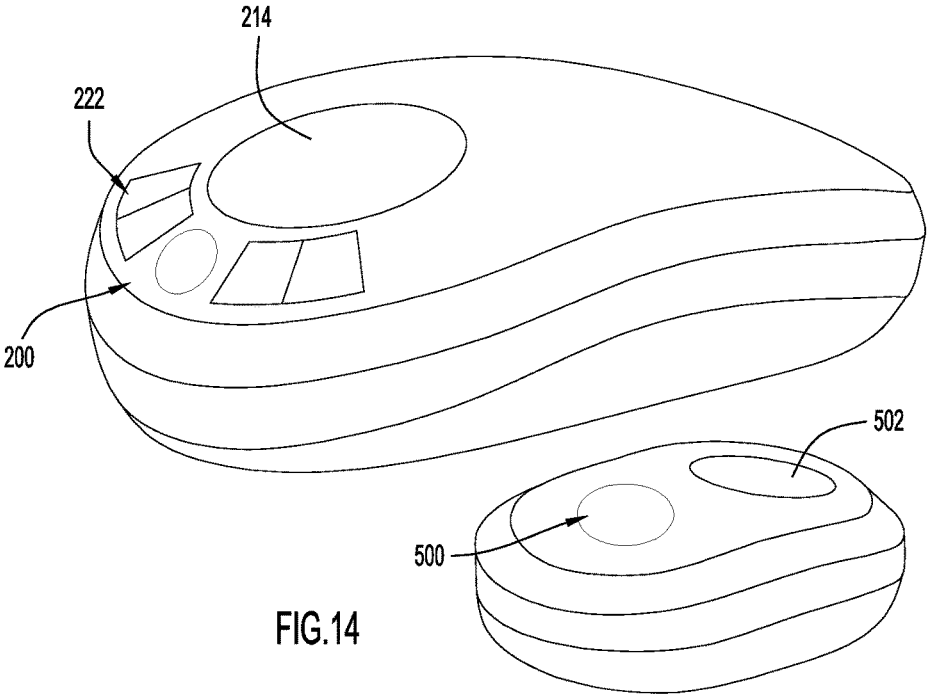
FIG. 14 shows a top perspective view of the soother of FIGS. 12 and 13 removed from the mobile arm.

For example, in the embodiments illustrated in FIGS. 11-13, the connector 224 may support mobiles, such as exemplary mobile 300 or exemplary mobile 400 and the mobile mechanism 280 may be configured to spin, rotate, or otherwise move the mobile 300, 400 when it is connected to the soother 200 via connector 224. Moreover, when either mobile 300 or mobile 400 is connected to the soother 200, the lens mechanism 250 may be configured to project light onto the mobile 300, 400, as the mobile 300, 400 is spinning. Preferably, at least a portion of each of mobile 300 and mobile 400 is removably coupled to the connector 224 so that the mobiles 300, 400 can be removed when the soother 200 is removed from the mobile arm 150 so that the soother 200 may sit flat on a support surface, as shown in FIG. 14. Additionally or alternatively, the connector 224 may be removably coupled to the remainder of the soother 200.

In FIG. 11, the mobile 300 includes a canopy 302 and a number of toys 304 disposed around the periphery of a substantially circular bottom screen (not shown). The canopy 302 and toys 304 are suspended beneath the soother 200 and aligned with the first (i.e. bottom) housing lens 206 such that any light projected downwards from the soother 200 may shine through, or at least on, the bottom screen and the canopy 302 to light up indicia disposed thereon (i.e., animal characters). In particular, the canopy 302 is a substantially frusto-conical, semi-translucent material that extends around the entire periphery of the bottom screen and is aligned with the connector 224. Consequently, when the lens mechanism 250 is projecting light downwards and the mobile mechanism 280 is activated, the mobile 300 may provide moving toys and lights that may soothe and/or entertain a child.

Similar to mobile 300, the mobile 400 depicted in FIGS. 12 and 13 includes a canopy 402 and a number of toys 404 disposed around a bottom screen 410. However, in this embodiment, the canopy extends between the bottom screen 410 and the connector 224. Moreover, as shown in FIG. 13, the bottom screen 410 may be illuminated by light projected from the soother 200 and show or display images projected from the soother. In the specific embodiment depicted in FIGS. 12 and 13, the soother 200 illuminates any indicia included on the mobile 400 (including the canopy 402) and projects an image 412 (which may be rotating due to rotation of a lens or screen in the lens mechanism 250) onto the bottom screen 410. Additionally or alternatively, the soother may also project images of stars onto mobile 400 (which may or may not also be rotating), such that stars appear in the canopy 402 and on the bottom screen 410. If an image projected onto the mobile, such as image 412 and/or stars is rotating (i.e., a screen included in the lens assembly is rotating or spinning), at a different rate than the mobile 400, the image 412 may rotate at a different rate than toys 404. Moreover, if the image 412 rotates at a different rate than stars projected onto the mobile 400 (i.e., if the stars and image 412 are included on separate screens in the lens mechanism 250 and rotated at two different speeds), the stars may appear to be rotating around the image 412.

Now referring to FIG. 14, the soother 200 from the embodiment of FIGS. 12 and 13 is shown removed from the mobile arm 150, being used in a stand-alone mode (i.e., atop of a desk or dresser). As mentioned, in this mode, the soother 200 is configured to project light upwards, perhaps around a room, through second housing lens 214. Moreover, in this mode, the mobile 400 is removed from the soother 200 in order to allow the soother 200 to easily sit atop of a support surface. In some embodiments, the connector 224 may also be removed in order to remove any obtrusive features from the soother. Additionally or alternatively, the connector 224 may be formed from a softgoods material, so the connector 224 provides a cushion for the soother 200 to rest upon.

Still referring to FIG. 14, as mentioned, in some embodiments, the system 100 may also include an IR receiver 218 so that a parent can control the system 100 (and, in particular, the soother 200) remotely. One example remote 500 is illustrated in FIG. 14. In this embodiment, the remote 500 only includes an activation bottom 502 so that the parent can turn the soother 200 on or off. However, in other embodiments, the remote 500 may also include functionality to allow a parent to control any controls 222 of the soother 200. In still other embodiments, the functionality provided by the remote 500 may be incorporated into an application for a smartphone or other such mobile electronic device and communicate with the system via any wireless connection, such as Bluetooth LE.

In view of the structure and features described herein, the infant entertainment system provided herein provides a soother that is suitable for use with and as a mobile, as well as for stand-alone use in or around a crib. The infant entertainment system provides a soother that is safe for use in and around a crib because it does not include any external or accessible moving parts when detached from a mobile arm. In other words, the infant entertainment system presented herein disables external movement when removed from a mobile arm. Moreover, since the soother can project light patterns upwards when removed from the mobile arm (and may automatically switch to projecting upwardly as it is removed), it is capable of projecting light patterns on and around a child's room and furniture. The soother presented herein may also conserve energy and battery life by deactivating the mobile mechanism when removed from the mobile arm.

Furthermore, the infant entertainment apparatus provided herein may provide coordinated lights, sounds, and movement when mounted on a mobile arm. In these embodiments, the infant entertainment system may shine light projections downwards into a crib and/or onto a mobile/canopy to entertain a child while also spinning a mobile. In embodiments where the system projects a rotating image, the rotating image may be configured to rotate at the same speed as the mobile, or at any desirable different speed. Moreover, the system 100 may automatically shift between shining light projections downwards and shining light upwards as it is mounted on a mobile arm (or vice versa, as it is removed therefrom), thereby reducing the number of tasks for a parent to perform as the parent is putting his or her child to sleep.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. For example, although an embodiment of the infant entertainment system described herein attaches a soother to a mobile arm by inserting the mobile arm into the soother, other embodiments may couple the soother to the mobile arm by inserting the soother into a portion of a mobile arm or any other manner. Moreover, the lens mechanism and mobile mechanism described herein may be triggered or actuated in any manner, such as electronically or via different mechanical actuations than those described herein, provided that the soother projects light in a first direction when mounted to a mobile arm, projects light in a second direction when removed from the mobile arm, activates a mobile mechanism (i.e. causes a toy or mobile to move) when mounted to the mobile arm and deactivated a mobile mechanism (i.e., prevents external movement) when removed from the mobile arm. In addition, various features from one of the embodiments may be incorporated into another of the embodiments. Accordingly, it is appropriate that the appended claims be construed broadly and in a manner consistent with the scope of the disclosure as set forth in the following claims.

It is also to be understood that the infant entertainment system described herein, or portions thereof may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Finally, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

What is claimed:

1. An infant entertainment apparatus comprising:

a housing with an internal cavity;

a lens mechanism disposed within the internal cavity, the lens mechanism projecting light from the housing in only a first direction when the housing is coupled to a mobile arm and the lens mechanism automatically projecting light from the housing in only a second direction, different from the first direction, when the housing is decoupled from the mobile arm.

2. The infant entertainment apparatus of claim 1, wherein the first direction is opposite the second direction.

3. The infant entertainment apparatus of claim 2, wherein the first direction is downwards and the second direction is upwards.

4. The infant entertainment apparatus of claim 1, wherein the housing further comprises:

a first housing lens disposed in a bottom portion of the housing; and a second housing lens disposed in a top portion of the housing, wherein light projected in the first direction exits the housing through the first lens and light projected in the second direction exits the housing through the second lens.

5. The infant entertainment apparatus of claim 1, wherein the lens mechanism comprises:

a movable optical component configured to automatically move from a second position to a first position as the housing is coupled to the mobile arm, wherein the movable optical component causes the lens mechanism to project light from the housing in only the first direction when in the first position and causes the lens mechanism to project light from the housing in only the second direction when in the second position.

6. The infant entertainment apparatus of claim 5, further comprising:

a light source, wherein the movable optical component is a rotatable optical component that is rotatable between the first position and the second position, configured to direct light from the light source in only the first direction when in the first position, and configured to direct light from the light source in only the second direction when in the second position.

7. The infant entertainment apparatus of claim 5, wherein the first position and the second position are separated by approximately 90 degrees.

8. The infant entertainment apparatus of claim 6, wherein the light projected from the light source is configured to pass through a rotatable image.

9. The infant entertainment apparatus of claim 5, wherein the optical component is biased to the second position such that the optical component is in the second position when the housing is decoupled from the mobile arm.

10. The infant entertainment apparatus of claim 5, further comprising:

a trigger mechanism, wherein the mobile arm is configured to activate the trigger mechanism when the housing is coupled to the mobile arm, and activation of the trigger mechanism causes the optical component to automatically move from the second position to the first position.

11. The infant entertainment apparatus of claim 1, further comprising:

a mobile mechanism that is activated when the housing is coupled to the mobile arm and deactivated when the housing is not coupled to the mobile arm.

12. The infant entertainment apparatus of claim 1, further comprising:

a mobile or canopy configured to receive the light projected in the first direction.

13. An infant entertainment apparatus comprising:

a housing with an internal cavity;

a lens mechanism disposed within the internal cavity, wherein the lens mechanism projects light from the housing in only a first direction when the housing is coupled to a mobile arm and automatically projects light from the housing in only a second direction, different from the first direction, when the housing is decoupled from the mobile arm; and a mobile mechanism that is activated when the housing is coupled to the mobile arm and deactivated when the housing is decoupled from the mobile arm.

14. The infant entertainment apparatus of claim 13, further comprising:

at least one of a canopy and a mobile extending from the housing and coupled to the mobile mechanism, wherein the at least one of a canopy and a mobile is configured to receive the light projected in the first direction.

15. The infant entertainment apparatus of claim 14, wherein the mobile mechanism comprises:

a motor; and a gear assembly configured to translate motion from the motor to the at least one of a canopy and a mobile independent of the lens mechanism, wherein the motor and the gear assembly are disposed inside the internal cavity.

16. An infant entertainment system comprising:

a mobile arm including a mounting portion; and an infant entertainment device comprising:

a housing configured to be mounted on the mounting portion of the mobile arm;

a lens assembly configured to project light from the housing; and a trigger assembly configured to be actuated as the housing is mounted on the mobile arm, wherein actuation of the trigger assembly causes the lens assembly to move from a position in which the lens assembly projects light in an upward direction to another position in which the lens assembly projects light in a downward direction.

17. The infant entertainment system of claim 16, wherein the housing further comprises:

a receptacle disposed on a side of the housing and configured to receive the mounting portion of the mobile arm such that the mobile arm extends at least partially within the housing during actuation.

18. The infant entertainment system of claim 16, wherein the mounting portion of the mobile arm comprises:

an engagement portion configured to actuate the trigger assembly as the housing is mounted on the mobile arm.

19. The infant entertainment system of claim 16, wherein the system provides a crib attached soother and mobile when the infant entertainment device is mounted on the mobile arm and the system provides a stand alone soother when the infant entertainment device is removed from the mobile arm, the stand alone soother being positioned in or around a crib.

20. The infant entertainment system of claim 16, further comprising:

at least one of a mobile or a canopy configured to receive the light projected in the downward direction.

* * * * *